US010382867B2

(12) United States Patent
Ishizaki et al.

(10) Patent No.: US 10,382,867 B2
(45) Date of Patent: Aug. 13, 2019

(54) VOICE RECORDER

(71) Applicant: TEAC Corporation, Tokyo (JP)

(72) Inventors: Hironao Ishizaki, Tokyo (JP); Taishi Toyono, Tokyo (JP)

(73) Assignee: TEAC CORPORATION, Tokyo (JP)

( * ) Notice: Subject to any disclaimer, the term of this patent is extended or adjusted under 35 U.S.C. 154(b) by 0 days.

(21) Appl. No.: 15/908,317

(22) Filed: Feb. 28, 2018

(65) Prior Publication Data

US 2018/0262838 A1 Sep. 13, 2018

(30) Foreign Application Priority Data

Mar. 9, 2017 (JP) ..... 2017-044745

(51) Int. Cl.
*H04R 5/027* (2006.01)
*H04R 3/00* (2006.01)

(52) U.S. Cl.
CPC ..... *H04R 5/027* (2013.01); *H04R 3/005* (2013.01)

(58) Field of Classification Search
CPC ..... H04N 13/204; H04R 1/406; H04R 5/027; H04S 1/005; G10K 11/1786; G10L 15/00
USPC ..... 381/1, 26, 92, 110, 355; 348/373; 379/32.01, 88.19; 455/413
See application file for complete search history.

(56) References Cited

U.S. PATENT DOCUMENTS 5,548,335 A * 8/1996 Mitsuhashi ..... H04N 5/772 348/231.4
5,982,857 A * 11/1999 Brady ..... H04M 1/656 379/265.01
6,856,689 B2 * 2/2005 Sudo ..... H04R 1/04 381/355
7,203,285 B2 * 4/2007 Blair ..... H04M 3/42221 379/265.06
7,769,364 B2 * 8/2010 Logan ..... G08B 13/1427 379/68
9,510,090 B2 * 11/2016 Lissek ..... H04M 1/035
9,984,675 B2 * 5/2018 Schuster ..... G10L 15/00
2007/0081674 A1 * 4/2007 Kim ..... H04S 1/00 381/1
2008/0260180 A1 * 10/2008 Goldstein ..... H04R 25/50 381/110
2008/0310649 A1 * 12/2008 Yamada ..... H04R 3/005 381/92

(Continued)

FOREIGN PATENT DOCUMENTS

JP 2007-43510 A 2/2007
JP 2009-171249 A 7/2009
JP 2010-21667 A 1/2010

*Primary Examiner* — Gerald Gauthier
(74) *Attorney, Agent, or Firm* — Seed IP Law Group LLP

(57) ABSTRACT

The voice recorder includes a right-and-left pair of microphones. Each microphone is fixed to a holder that is rotatable about a rotation axis, and a sound-collection axis of each microphone is tilted to the rotation axis. Turning each holder by 180 degrees allows each microphone to change over between an inward position where the sound-collecting axes SAX of the microphones intersect and an outward position where the sound-collecting axes do not intersect. Each microphone is placed offset from the rotation axis on each holder in such a direction that the sound-collecting axes are spaced apart from each other in a height-direction (Z-direction) while the microphones are in the inward position.

12 Claims, 17 Drawing Sheets

Perspective View Of Voice Recorder With Microphones In Inward Position

(56) References Cited

U.S. PATENT DOCUMENTS

| | | | | |
|---|---|---|---|---|
| 2009/0010456 | A1* | 1/2009 | Goldstein | H04R 25/02 381/110 |
| 2010/0008511 | A1* | 1/2010 | Kawano | H04R 5/027 381/26 |
| 2012/0063613 | A1* | 3/2012 | Sato | H04R 3/005 381/92 |
| 2012/0224716 | A1* | 9/2012 | Ohtsuka | H04R 5/027 381/92 |
| 2014/0050326 | A1* | 2/2014 | Vesa | H04R 5/027 381/26 |
| 2016/0269844 | A1* | 9/2016 | Ding | H04R 1/1041 |
| 2017/0099545 | A1* | 4/2017 | Iijima | H04R 5/027 |
| 2017/0236547 | A1* | 8/2017 | Baggio | G11B 20/10527 381/26 |
| 2017/0303043 | A1* | 10/2017 | Young | H04R 5/027 |
| 2018/0114518 | A1* | 4/2018 | Scanlan | H04R 29/005 |
| 2018/0262747 | A1* | 9/2018 | Meirlaen | H04R 5/027 |
| 2018/0262837 | A1* | 9/2018 | Makino | H04R 1/406 |
| 2018/0262838 | A1* | 9/2018 | Ishizaki | H04R 5/027 |

* cited by examiner

Perspective View Of Voice Recorder With Microphones In Inward Position

Perspective View Of Voice Recorder With Microphones in Outward Position

Example Of Diaphragm Of Microphone Of Voice Recorder

Example Of Intersection Of Sound-Collecting Axes In Inward Position

Example Of Sound-Collecting Axes in Outward Position

Front View Of Microphones In Inward Position

Bottom View Of Microphones In Inward Position

Exploded Perspective View Of Voice Recorder

Mounting Structure For Microphones

Interlocking Mechanism Of Microphones

Joint Member And Mounting Position Thereof

Microphones In Inward Position

Microphones Turned 45 Degrees From Inward Position

Microphones Turned 90 Degrees From Inward Position

Microphones Turned 135 Degrees From Inward Position

Microphones Turned 180 Degrees From Inward Position

Diagram Corresponding To FIG. 12A, Viewed From Back Side

Diagram Corresponding To FIG. 12B, Viewed From Back Side

Diagram Corresponding To FIG. 12C, Viewed From Back Side

Diagram Corresponding To FIG. 12D, Viewed From Back Side

Diagram Corresponding To FIG. 12E, Viewed From Back Side

Perspective View Illustrating Method To Fix Wires To Circuit Board

Plan View Illustrating Method To Fix Wires To Circuit Board

Example In Which Diaphragms Overlap Each Other At Edge Portions Thereof

Example In Which Cases Overlap Each Other At Edge Portions Thereof

VOICE RECORDER

CROSS-REFERENCE TO RELATED APPLICATIONS

The present application claims priority under 35 U.S.C. § 119 to Japanese Patent Application No. 2017-044745, filed on Mar. 9, 2017. The above application(s) is hereby expressly incorporated by reference, in its entirety, into the present application.

BACKGROUND OF THE INVENTION

1. Field of the Invention

The present invention relates to a voice recorder for recording voices.

2. Description Relating to the Prior Art

A voice recorder for recording voices input through a microphone is known (refer to patent document 1). In addition to the microphone, the voice recorder also has, for example, an IC memory in which voice data can be recorded and a speaker, and is capable of reproducing the voice data. Such voice recorders are also called IC recorders, and the like. Many voice recorders have a right-and-left pair of microphones to be capable of recording in stereo.

Some voice recorders having a right-and-left pair of microphones are equipped with two barrel type microphones on one side of a box-like body section, for example. Among these voice recorders, such a type of products are conventionally known that are capable of changing the microphones between an outward position in which a sound-collection axis perpendicular to a diaphragm of one microphone does not intersect a sound-collection axis of the other, and an inward position in which the sound-collection axes intersect each other (refer to patent documents 1 to 3 and non-patent document 1). In general, the outward position is called A-B configuration, and the inward position is called X-Y configuration. There are a variety of configurations for changing the position of each microphone.

PRIOR ART DOCUMENTS

Patent Documents

Patent Document 1: JPA No. 2007-043510

Patent Document 2: JPA No. 2009-171249

Patent Document 3: JPA No. 2010-021667 (corresponding to US 2010/0008511 A1)

Non-Patent Document

Non-Patent Document 1: Zoom Company Limited, Handy Video Recorder Q4n User's Guide, p. 3 to p. 5 (2015 ZOOM CORPORATION)

In the inward position (X-Y configuration), setting the microphones to intersect each other in different heights from each other is preferable to spacing the microphones from each other in the right to left direction, because phase difference between the right and left microphones is reduced when the microphones intersect each other, as described in non-patent document 1.

However, in the prior art in non-patent document 1, the change between the outward position (A-B configuration) and the inward position (X-Y configuration) requires a sliding operation to make the heights of the microphones different, in addition to a turning operation to turn each microphone by 180 degrees to bring the microphones to the intersected position. In addition to the intricate operation, this prior art requires two mechanisms to turn and to slide the microphones, and thus involves a problem of complicating the structure.

The object of the present invention is to provide a voice recorder with a right-and-left pair of microphones, which can change over between an inward position (X-Y configuration) with little phase difference and an outward position (A-B configuration), without any intricate operation or complicated structure.

SUMMARY OF THE INVENTION

For the above mentioned object, a voice recorder of the present invention is provided with a body section, a pair of right and left microphones, and a couple of holders. The microphones are provided on the body section, each microphone having a diaphragm to collect voices, and each sound-collecting axis perpendicular to the diaphragm extends in an axial direction of the microphone. The couple of holders are placed side by side in the body section in such a manner that the holders are capable of turning on individual rotation axes which are parallel to each other, and the holders hold the microphones with the sound-collecting axes tilted to the rotation axes, respectively. By turning each microphone 180 degrees from an inward position in which the sound-collecting axes of the microphones intersect each other, the microphones are changed to an outward position in which the sound-collecting axes of the microphones do not intersect. Each microphone is placed offset from the individual rotation axis on each holder in such a direction that, in the inward position, the sound-collecting axes are spaced apart from each other in a vertical direction parallel to a vertical plane which is perpendicular to both of the parallel rotation axes.

It is preferable that each sound-collecting axis is parallel to a horizontal plane perpendicular to the vertical plane in the inward position and in the outward position.

It is preferable to stagger the holders in such a manner that the respective rotation axes are spaced apart from each other in the vertical direction.

It is preferable that each microphone has the same offset which is a distance from the rotation axis of each holder to the sound-collecting axis of one microphone held on the one holder, in the vertical plane.

Assuming that PV represents a distance between the rotation axes of the holders in the vertical direction, the distance PV is determined by formula (1) below, and the offset distance OF S of each microphone is preferably equal to a half of the distance PV, that is, PV/2.

$$PV=(D/2+D/2+C)/2 \qquad \text{formula (1)}$$

Wherein, D is a diameter of each microphone and C is a clearance between the microphones.

When the distance between the rotation axes of the holders in the horizontal plane is assumed as PH, the distance PH is determined by formula (2) below, on the basis of an intersection point at which the two sound-collecting axes of the microphones intersect.

$$PH=2L\cdot\cos(90°-\theta/2) \qquad \text{formula (2)}$$

Wherein, L is a length of each sound-collecting axis from the intersection point to the rotation axis of each holder, and θ is an angle between the two intersecting sound-collecting axes.

It is preferable that the diaphragms of the microphones intersect each other in the inward position. More preferably, the diagrams of the microphones intersect at the center of each diaphragm in the inward position.

It is preferable to provide an interlocking mechanism which interlocks the holders to cause one holder to turn as the other holder is turned.

It is preferable that the interlocking mechanism includes a joint member which transmits a turning force of one holder to the other holder as a turning force therefor. The joint member is connected on opposite ends thereof to the holders at positions where the opposite ends are in offset from respective rotation centers of the holders. The joint member has an arm portion and two joint portions which are provided on opposite ends of the arm portion and are respectively connected to the holders, wherein each joint portion is bent into an L shape in the same direction with respect to a longitudinal direction of the arm portion.

It is preferable that a wire for sending electrical signals responsive to vibration of the diaphragm to the body section is drawn from an aperture formed in each holder at a position including the rotation center of the holder.

It is preferable to provide a circuit board to which one end of each of the wires drawn from the diaphragms is connected, and apertures in the circuit board, for putting the wires therethrough and winding the wires on the circuit board.

According to the present invention, the voice recorder equipped with the right-and-left pair of microphones can change the microphones between the inward position (X-Y configuration) with little phase difference and the outward position (A-B configuration), without any intricate operation or complicated structure.

BRIEF DESCRIPTION OF THE DRAWINGS

The above and other objects and advantages of the present invention will be more apparent from the following detailed description of the preferred embodiments when read in connection with the accompanying drawings, wherein like reference numerals designate like or corresponding parts throughout the several views, and wherein.

DESCRIPTION OF PREFERRED EMBODIMENTS

Figure 1:
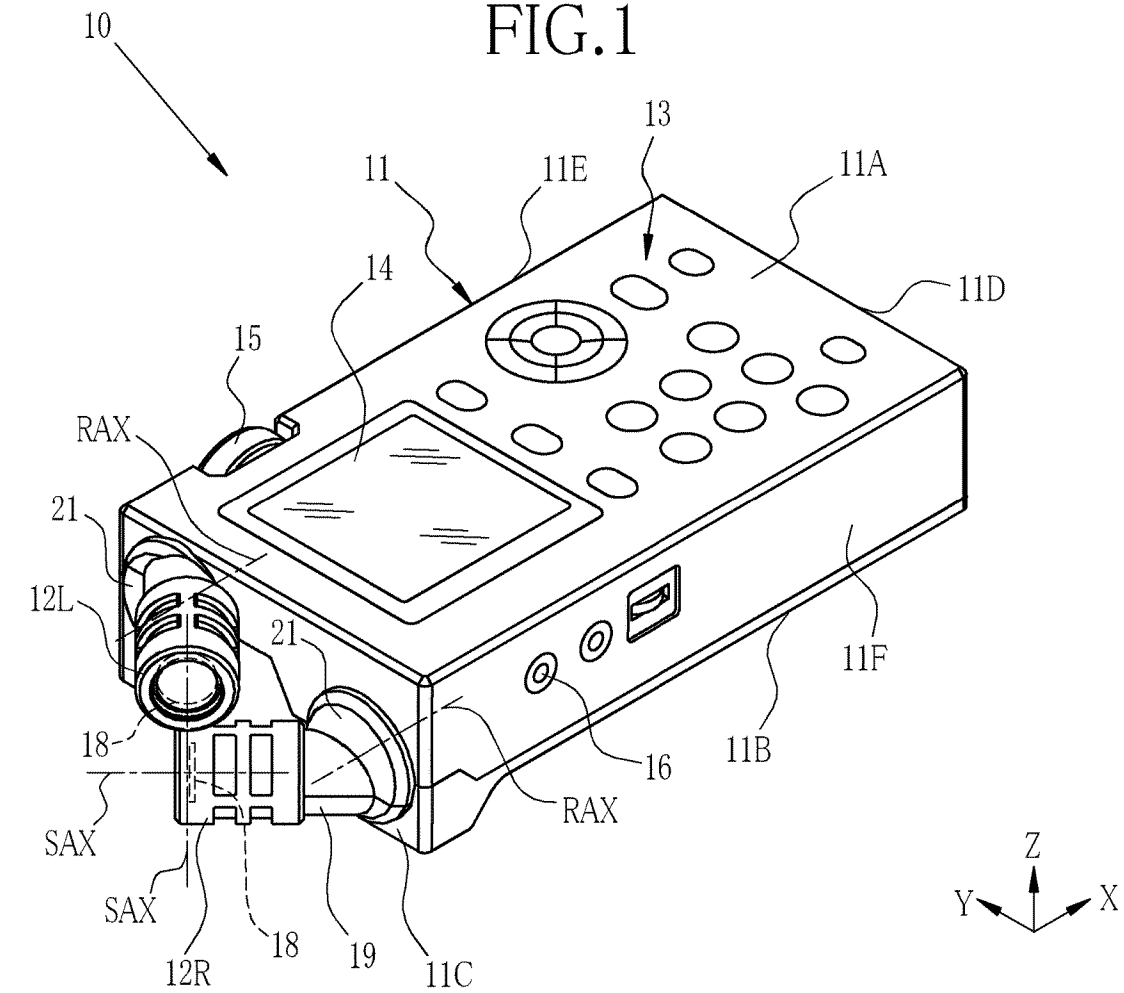
FIG. 1 is a perspective view illustrating the appearance of a voice recorder with a pair of microphones in an inward position.
Figure 2:
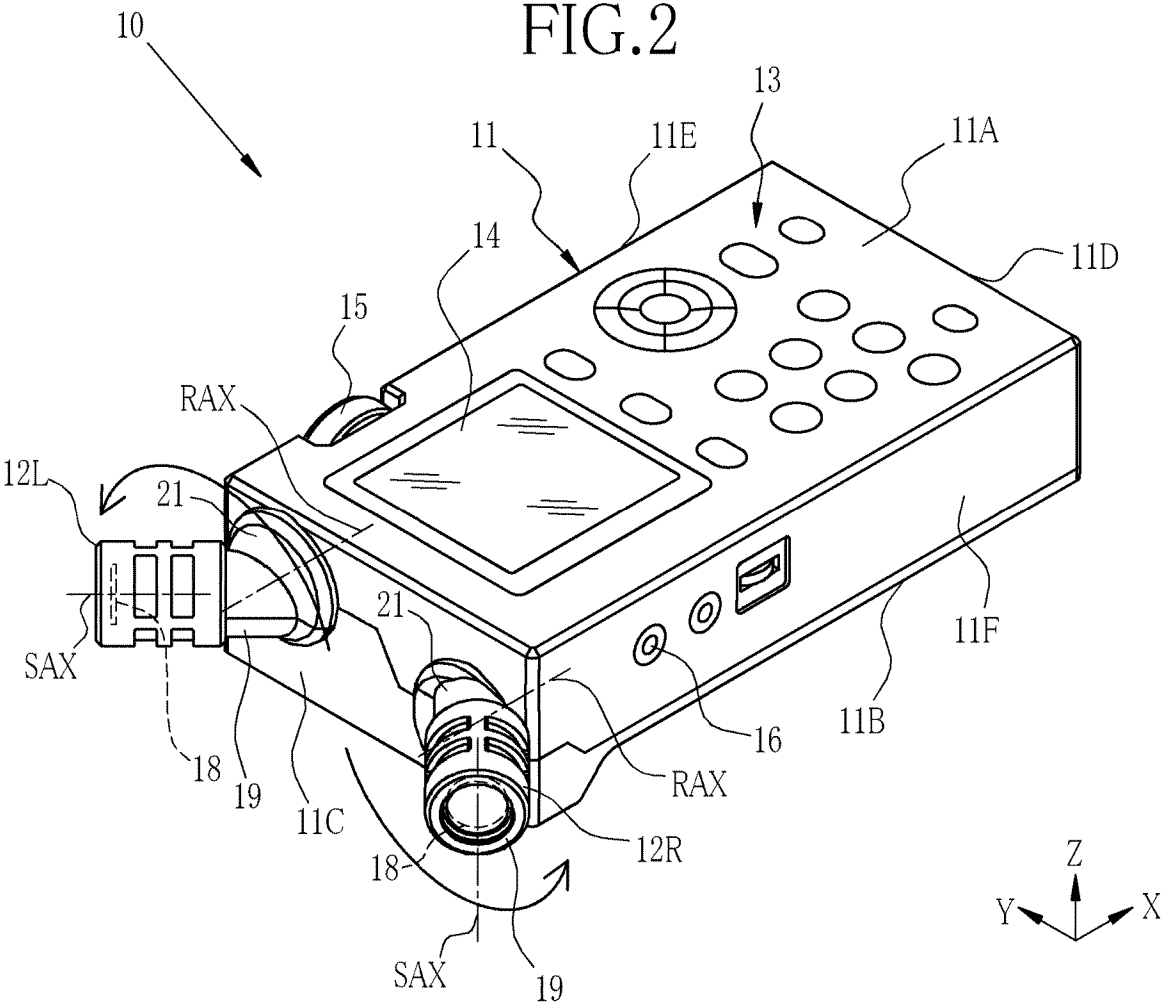
FIG. 2 is a perspective view illustrating the appearance of the voice recorder with the pair of microphones in an outward position.

As shown in FIGS. 1 and 2, a voice recorder 10, which is a portable small recorder, is provided with a body section 11 and a right-and-left pair of microphones 12R and 12L. The voice recorder 10 has a recording function to record voices input through the pair of microphones 12R and 12L and a playback function to play back the recorded voices. The body section 11, for example, is formed in a shape near a rectangular parallelepiped. The microphones 12R and 12L are disposed on one of two sides opposite in the longitudinal direction of the body section 11.

In a front position of the body section 11 having the aforementioned shape, as shown in FIGS. 1 and 2, the body section 11 is placed sideways with the longitudinal direction thereof (X-direction) oriented horizontal, and the pair of microphones 12R and 12L are directed to a sound source. Hereinafter, six surfaces of the body section are defined on the basis of the front position as follows.

Of the body section 11 set in the front position, upper and lower surfaces that face in the height-direction (Z-direction) are prescribed as a top surface 11A and a bottom surface 11B, respectively. Two sides that face in the longitudinal direction (X-direction) of the body section are prescribed as a front surface 11C and a back surface 11D, respectively, and other two sides that face in the width-direction (Y-direction) of the body section are prescribed as a left side surface 11E and a right side surface 11F, respectively.

An operating portion 13 and a displaying portion 14 are on the top surface 11A. The operating portion mainly includes, for example, a record button, a play button, a stop button, a selection button, and a cursor-movement button.

The cursor-movement button, which moves the cursor in an operating screen on the displaying portion 14, is used to mainly select various kinds of menu items and folders storing the voice data.

The displaying portion 14, for example, is a liquid crystal display (LCD), which displays mainly the names of files and folders for record and playback, the audio level at playback, and operating screens for various kinds of settings. A dial 15 to adjust the audio level is on the right side surface 11F and jacks 16 to mount an earphone and an external microphone are on the left side surface 11E. And a card slot (not illustrated) to accommodate a memory card to store the data is on the left side surface 11E.

The microphones 12R and 12L are placed on the front surface 11C. The microphone 12L is for the left direction and the microphone 12R for the right. Each microphone 12R, 12L is provided with a diaphragm 18 collecting voices and a case 19 accommodating the diaphragm 18. The case 19 has an approximately cylindrical shape, and the diaphragm 18 is unitized integrally with, for example, a converter which converts vibration of the diaphragm 18 into an electrical signal. An open end side of the case 19 is provided with a head cover which is made, for example, of a metal mesh board, for protecting the internal diaphragm 18.

The diaphragm 18 is made of a metal foil and a synthetic resin film which have an approximately round shape. One surface of the diaphragm 18 is a sound-collecting surface to face the sound source, and an axis perpendicular to the sound-collecting surface is a sound-collecting axis SAX in each microphone 12R, 12L. The sound-collecting axis SAX coincides with the axial direction of the cylindrical case 19.

[Changing the Position of Each Microphone 12R, 12L]

A couple of holders 21 holding the pair of microphones 12R and 12L are provided on the front surface 11C, respectively. Base-ends of the microphones 12R and 12L are fixed to the respective holders 21. In the present embodiment, the holder 21 is formed integrally with the case 19. However, the holder 21 does not need to be formed integrally with the case 19.

Figure 6:
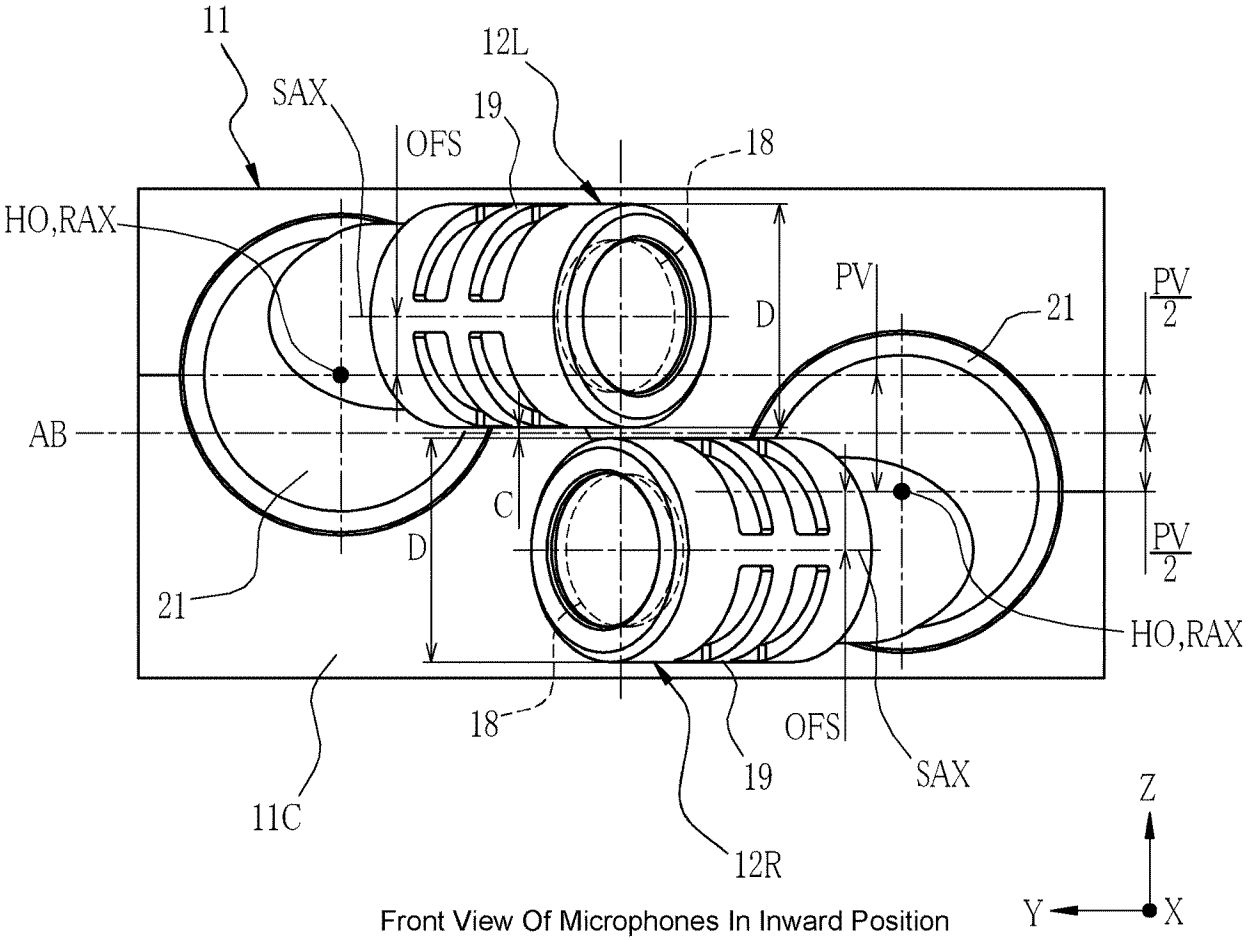
FIG. 6 is a front view of the pair of microphones in the inward position.

Each holder 21 is of a circular shape, a center location of which is a rotation center HO (refer to FIG. 6, and the like). Each rotation axis RAX across the rotation center HO of each holder 21 extends parallel in the direction perpendicular to the front surface 11C (the longitudinal direction (X-direction) of the body section 11). The holders 21 are placed side by side on the front surface 11C, being able to turn about the respective rotation axes RAX which are parallel to each other. Each holder 21 holds one of the microphones 12R and 12L with each sound-collecting axis SAX tilting to the rotation axis RAX.

Turning each holder 21 causes the position of each microphone 12R, 12L to change between a position shown in FIG. 1 and a position shown in FIG. 2. Specifically, turning each holder 21 180 degrees from the inward position where the sound-collecting axes SAX of the microphones 12R and 12L intersect, as shown in FIG. 1, causes the position of each microphone 12R, 12L to change to the outward position where the sound-collecting axes of the microphones 12R and 12L do not intersect, as shown in FIG. 2.

In general, the inward position shown in FIG. 1 is called X-Y configuration, and the outward position shown in FIG. 2 called A-B configuration. The diaphragms 18 of the microphones 12R and 12L are set closer to each other in the width-direction (Y-direction) in the inward position, as compared with the outward position (A-B configuration). Accordingly, in the inward position as shown in FIG. 1, when voices are recorded with the left and right microphones 12R and 12L being directed to a particular sound source and with the body section 11 being set in the front position, there is a small difference in distance from the particular sound source to the diaphragm 18 between the right and left microphones 12R and 12L. Thus, phase difference of sonic waves, which reach from the sound source to the right and left microphones 12R and 12L, is reduced between these microphones.

Figure 3:
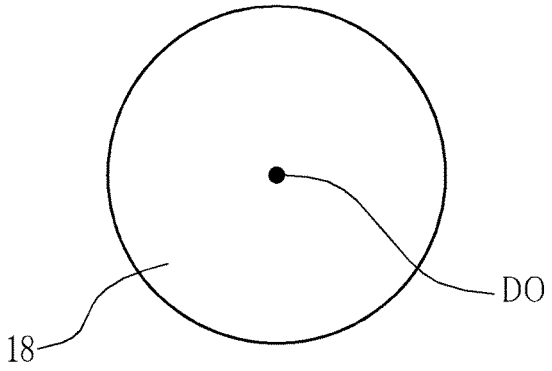
FIG. 3 is an explanatory diagram illustrating the center of a diaphragm.
Figure 4:
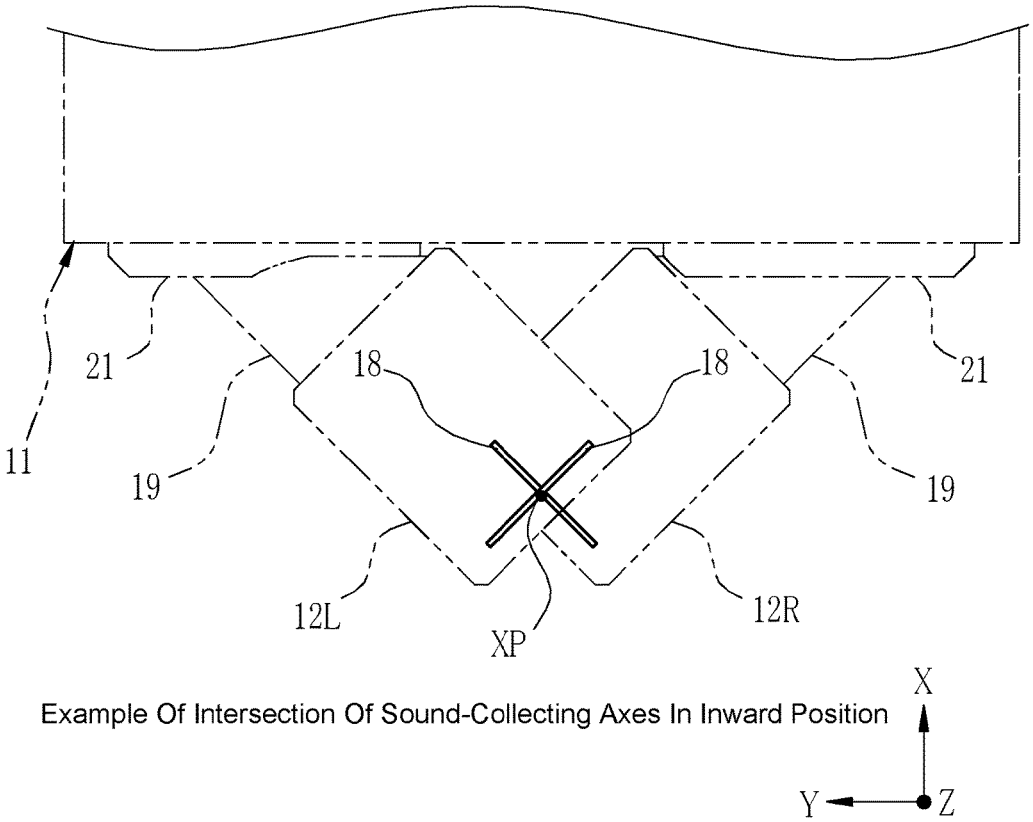
FIG. 4 is an explanatory diagram illustrating the intersection of sound-collecting axes in the inward position.

The most ideal arrangement in the inward position is the position where the right and left microphones 12R and 12L intersect at respective centers of the diaphragms 18. In this position, the right-and-left phase difference can be reduced to zero. The center of the diaphragm 18 is the center DO of the circular surface of the diaphragm 18, which is on the sound-collecting axis SAX, as shown in FIG. 3. Seen from the height-direction (Z-direction), as shown in FIG. 4, the inward position in this embodiment provides the ideal arrangement in which the centers DO of the diaphragms 18 of the right and left microphones 12R and 12L intersect.

Figure 5:
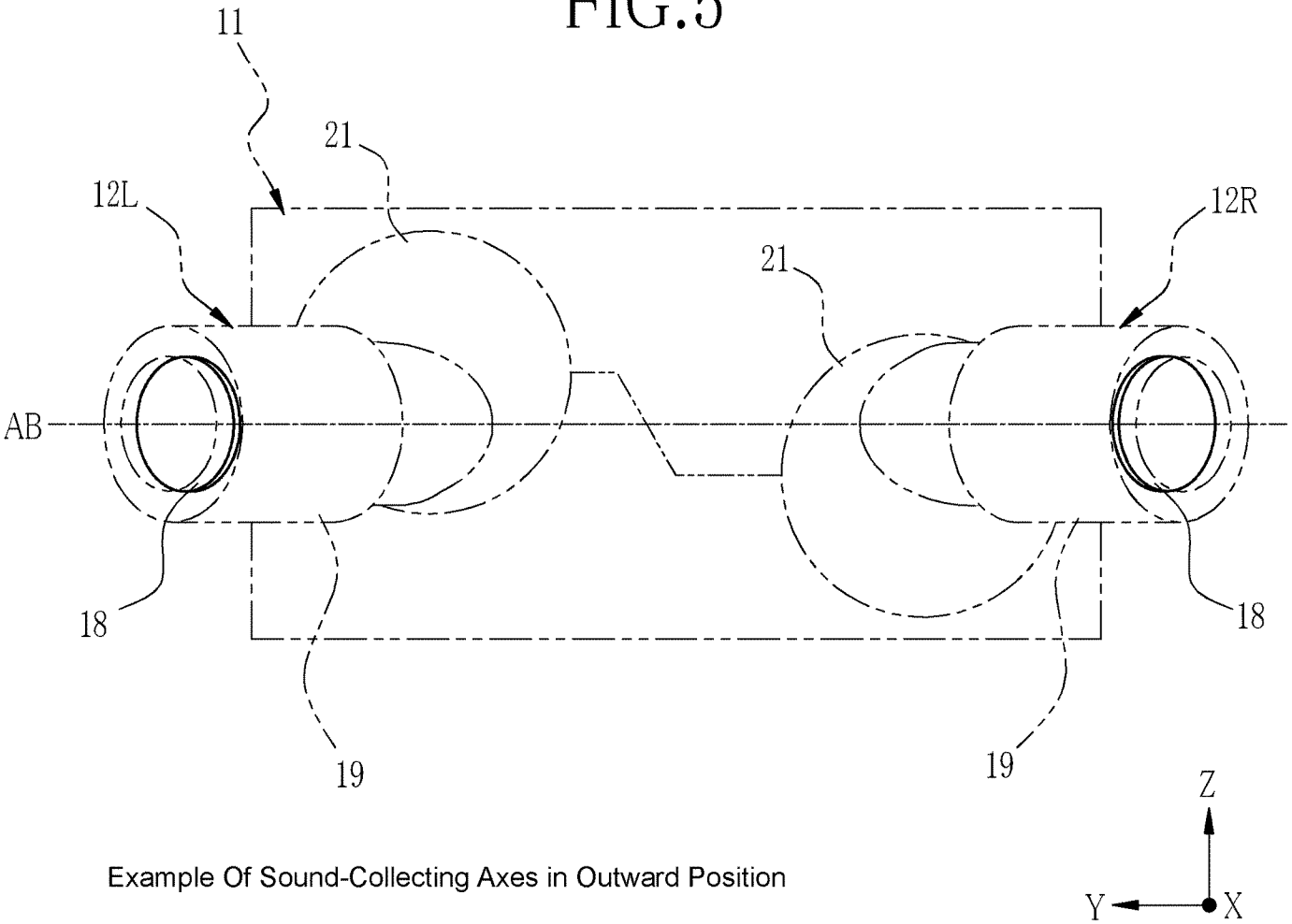
FIG. 5 is an explanatory diagram illustrating that the sound-collecting axes are in the same height in the outward position.

On the other hand, the outward position (A-B configuration) is the position where the sounds including neighboring environment sounds can be collected in addition to the particular sound source. In the outward position of this embodiment, with the body section in the front position, the right and left microphones 12R and 12L are in the same height in the Z-direction, as shown in FIG. 5. Specifically, in the outward position, the center DO of the diaphragm 18 of each microphone 12R, 12L is in the same height.

In addition, assuming that a plane perpendicular to both of the parallel rotation axes RAX, each of which extends across each rotation center HO of the corresponding holder 21, is referred to as a vertical plane (Y-Z plane), each sound-collecting axis SAX is, in the inward position and the outward position, parallel to a horizontal plane (X-Y plane) which is perpendicular to the vertical plane (Y-Z plane).

[Position of the Rotation Axis RAX of the Holder 21 in the Height-Direction (Z-Direction)]

In addition, as shown in FIG. 6, in the inward position, each microphone 12R, 12L is placed offset from the individual rotation axis RAX on each holder 21 in such a direction that the sound-collecting axes SAX are spaced apart in the height-direction (Z-direction) that is a vertical direction parallel to the vertical plane (Y-Z plane).

This offset arrangement makes it possible to avoid interference between the cases 19, even while the microphones 12R and 12L are set close to each other in the width-direction (Y-direction). As shown in FIG. 6, this offset arrangement in the inward position where the sound-collecting axes SAX of the microphones 12R and 12L intersect each other, accordingly, allows the cases 19 to intersect each other without interfering with each other.

In addition, this offset arrangement allows the change between the inward position where the phase difference is reduced due to the intersection of the cases 19, and the outward position where the sound-collecting axes SAX do not intersect.

In addition to the offset arrangement of each microphone 12R, 12L on the holder 21, the holders 21 are staggered so as to make the rotation axes apart from each other in the height-direction (Z-direction). Thereby, it becomes possible to adopt the arrangement for allowing the cases 19 to intersect each other even with a greater diameter of the cases 19, or the like, and thus improve the design flexibility.

In addition, as shown in FIG. 6, while the offset directions are 180-degree-opposite such that one side is in the upward direction and the other side in the downward direction, the offset distance is the same on either side. Thus, turning each holder by 180 degrees from the inward position to the outward position brings the microphones 12R and 12L into the same height.

The offset distance of each microphone 12R, 12L to the corresponding holder 21 and the distance in the height-direction between the rotation axes RAX, each extending across the rotation center HO of each holder 21, are determined as follows, specifically. First, in the vertical plane (Y-Z plane) which is perpendicular to both of the rotation axes RAX, the distance in the height-direction (Z-direction) between the rotation axes RAX of the holders 21 is designated by PV. In order to change the position of each microphone 12R, 12L between the inward position where the cases 19 of the microphones 12R and 12L intersect and the outward position where the microphones 12R and 12L are in the same height, as in this embodiment, the distance PV is determined as follows.

First, in the outward position, an AB line shown in FIG. 6 is a line interconnecting the sound-collecting axes SAX of the microphones 12R and 12L when the microphones 12R and 12L are in the same height, as shown in FIG. 5. The distance PV in the inward position is determined by the following formula (1) in relation to the AB line.

$$PV=(D/2+D/2+C)/2 \quad \text{Formula (1)}$$

Wherein, D is a diameter of each microphone 12R, 12L and C is a clearance between the cases 19 of the microphones 12R and 12L.

The rotation axes RAX of the holders 21 are spaced the distance PV from each other, and each rotation axis RAX is placed at the same distance from the AB line in the height-direction. The distance in the height direction (Z-direction) from the AB line to the rotation axis RAX of each holder 21 becomes PV/2, accordingly. The clearance C, which is a given value, is preferably set as small as possible insofar as the cases 19 do not contact each other.

In this embodiment, the microphones 12R and 12L are brought into the same height in the outward position turned by 180 degrees from the inward position. In this case, PV/2 must be equal to the offset distance OFS of the sound-collecting axis SAX from the rotation axis RAX on each holder 21: OFS=PV/2. Accordingly, determining the distance PV in accordance with formula (1) above can lead to determining the offset distance OFS.

Spacing the rotation axes RAX of the holders 21 by the distance PV apart from other in the height-direction thus allows the cases 19 of the microphones 12R and 12L to intersect each other in the inward position, while enabling setting the microphones 12R and 12L in the same height in the outward position.

[Position of the Rotation Axis RAX (the Rotation Center HO) of the Holders 21 in the Width-Direction (Y-Direction)]

Figure 7:
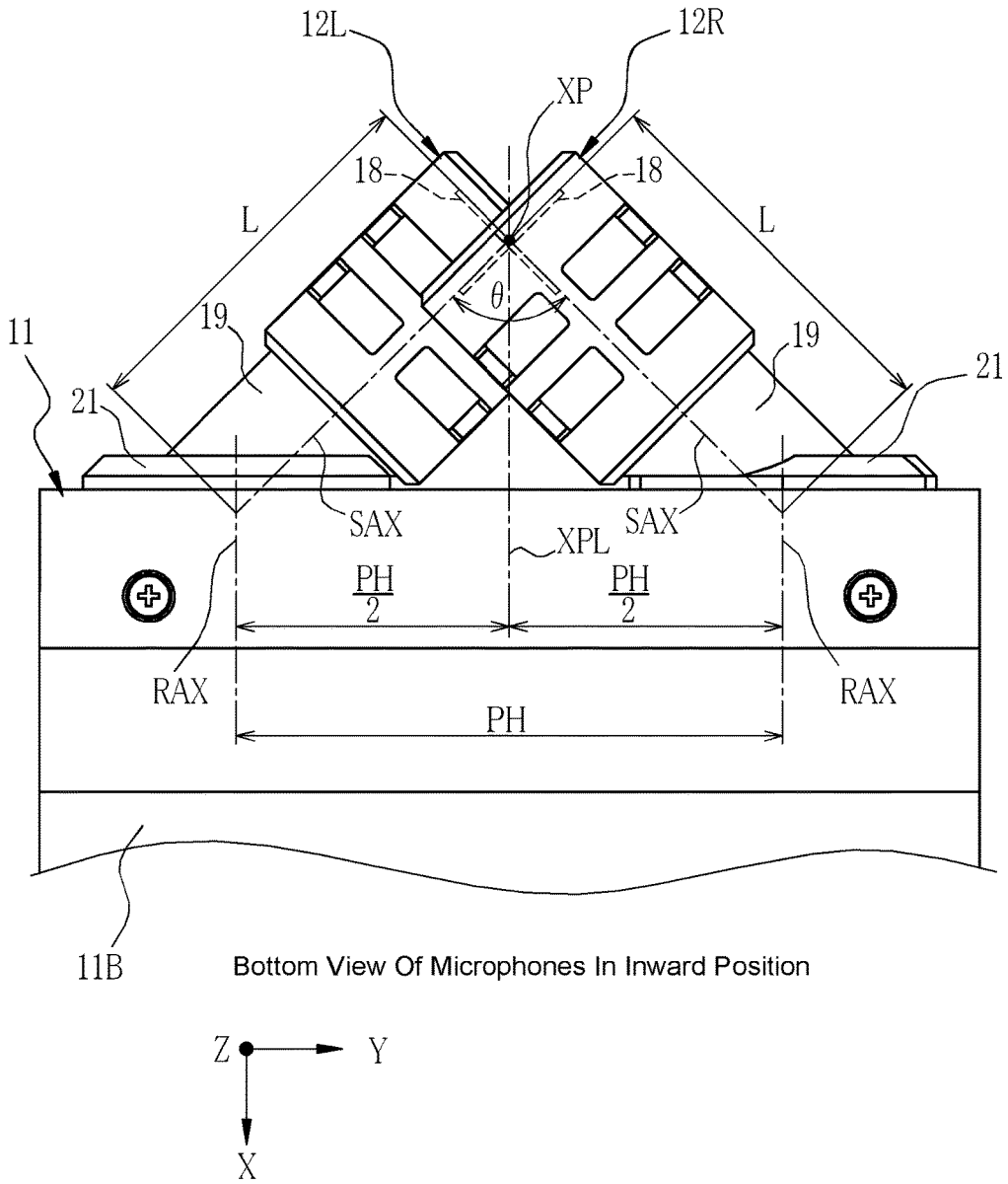
FIG. 7 is a bottom view of the pair of microphones in the inward position.

And as shown in FIG. 7, the rotation axes RAX of the holders 21 are spaced a distance PH apart in the width-direction (Y-direction) when the sound-collecting axes SAX of the microphones 12R and 12L intersect. The distance PH, which is the distance between the rotation axes RAX in the X-Y plane, the horizontal plane relative to the vertical Y-Z plane, is determined by the next formula (2) in relation to the intersection point XP at which the two sound-collecting axes SAX intersect.

$$PH=2L\cdot\cos(90°-\theta/2) \quad \text{Formula (2)}$$

Wherein, L is a length of each sound-collecting axis SAX from the intersection point XP to the rotation axis RAX that extends across the rotation center HO of the holder 21. θ is an angle between the two intersecting sound-collecting axes SAX.

Thus, the rotation axes RAX of the holders 21 are spaced the distance PH apart and at the same distance from the intersection point XP in the width-direction (Y-direction). That is, the distance between a straight line XPL through the intersection point XP and the rotation axis RAX of each holder 21 in the width-direction (Y-direction) becomes PH/2.

In this embodiment, in order to set the right-and-left phase difference to zero in the inward position, the diaphragms 18 of the microphones 12R and 12L are arranged to intersect each other so as the respective centers DO overlap as viewed from the Z-direction. Therefore, the point at which the centers DO of the diaphragms 18 overlap coincides with the intersection point XP, so that the position in the width-direction (Y-direction) of the rotation axis RAX of each holder 21 is determined by formula (2) above.

[Mounting Structure for the Holder]

Figure 8:
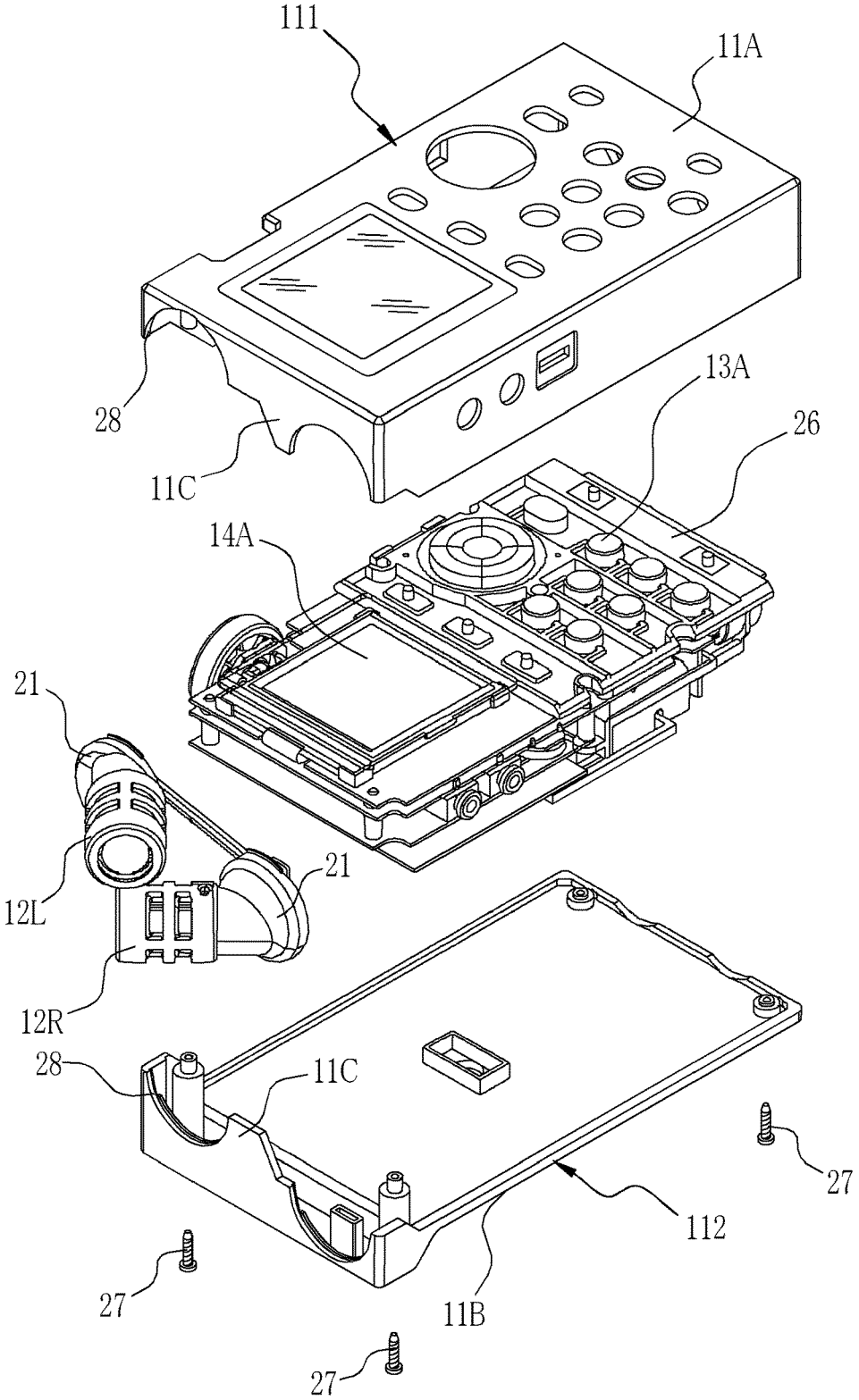
FIG. 8 is an exploded perspective view of the voice recorder.

As shown in FIG. 8, the body section 11 is provided with a top cover 111 having a top plate 11A, a bottom cover 112 having a down plate 11B, and a circuit board unit 26. The circuit board unit 26 is provided with electronic parts such as a displaying section 14A that constitutes the displaying portion 14 and an operating section 13A that constitutes the operating portion 13. In addition, the circuit board unit 26 is also provided with signal processing circuits such as an encoder and a decoder, and embedded IC memories. These parts are assembled and integrated into a unit. The top cover 111 and the bottom cover 112 are coupled, for example, with screws 27.

Figure 9:
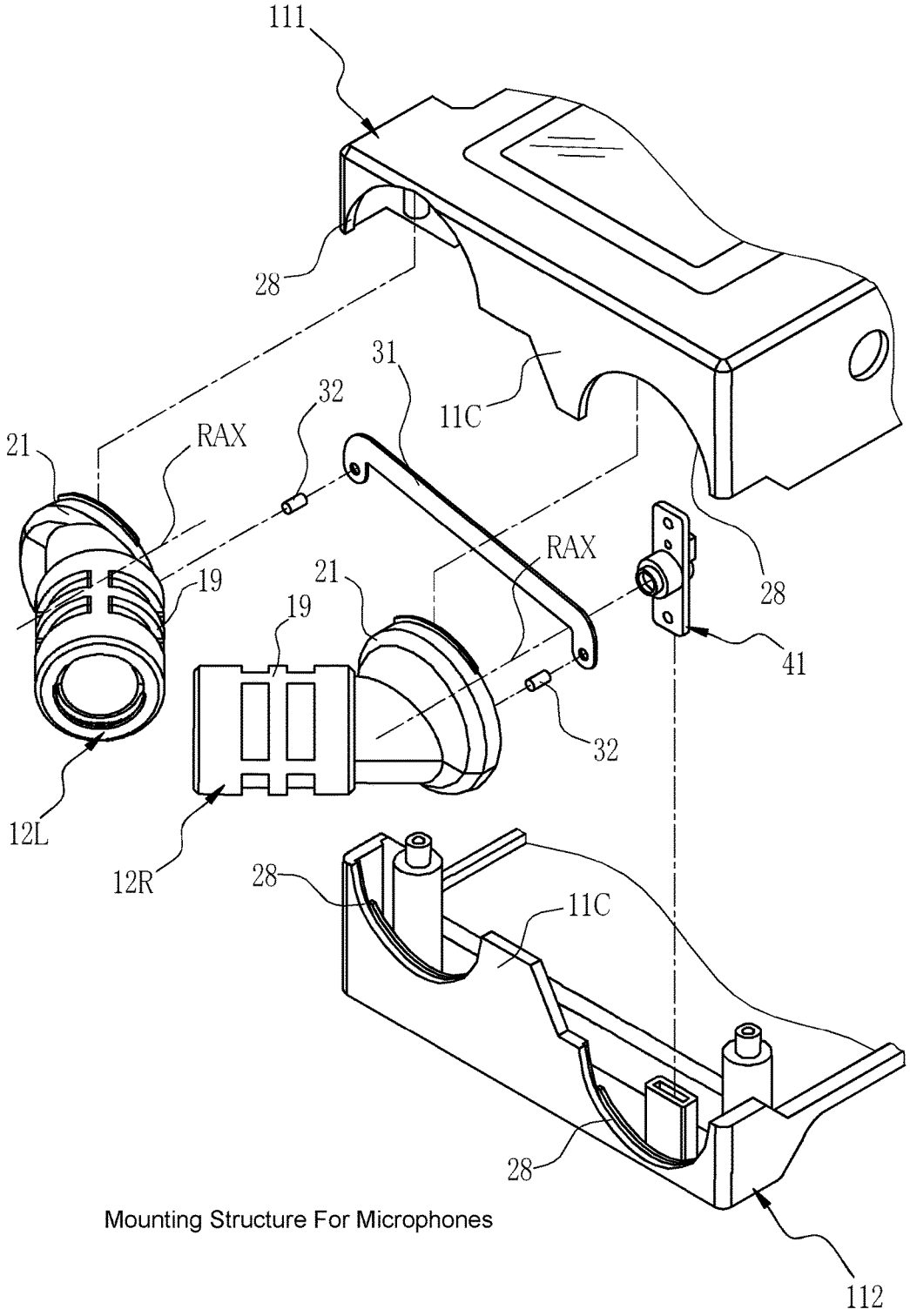
FIG. 9 is a diagram illustrating a mounting structure for the pair of microphones.

As shown in FIG. 9, half-round notches 28, engaging with the periphery of each holder 21, are formed in the top cover 111 and the bottom cover 112 on the side constituting the front surface 11C. When the top cover 111 and the bottom cover 112 are mated together, the counterpart notches 28 of the covers 111, 112 sandwich and engage with the holders 21. This engagement allows holding each holder 21 to be rotatable about the rotation axis RAX that extends through the rotation center HO of each holder.

[Interlocking Mechanism for the Holder]

Figure 10:
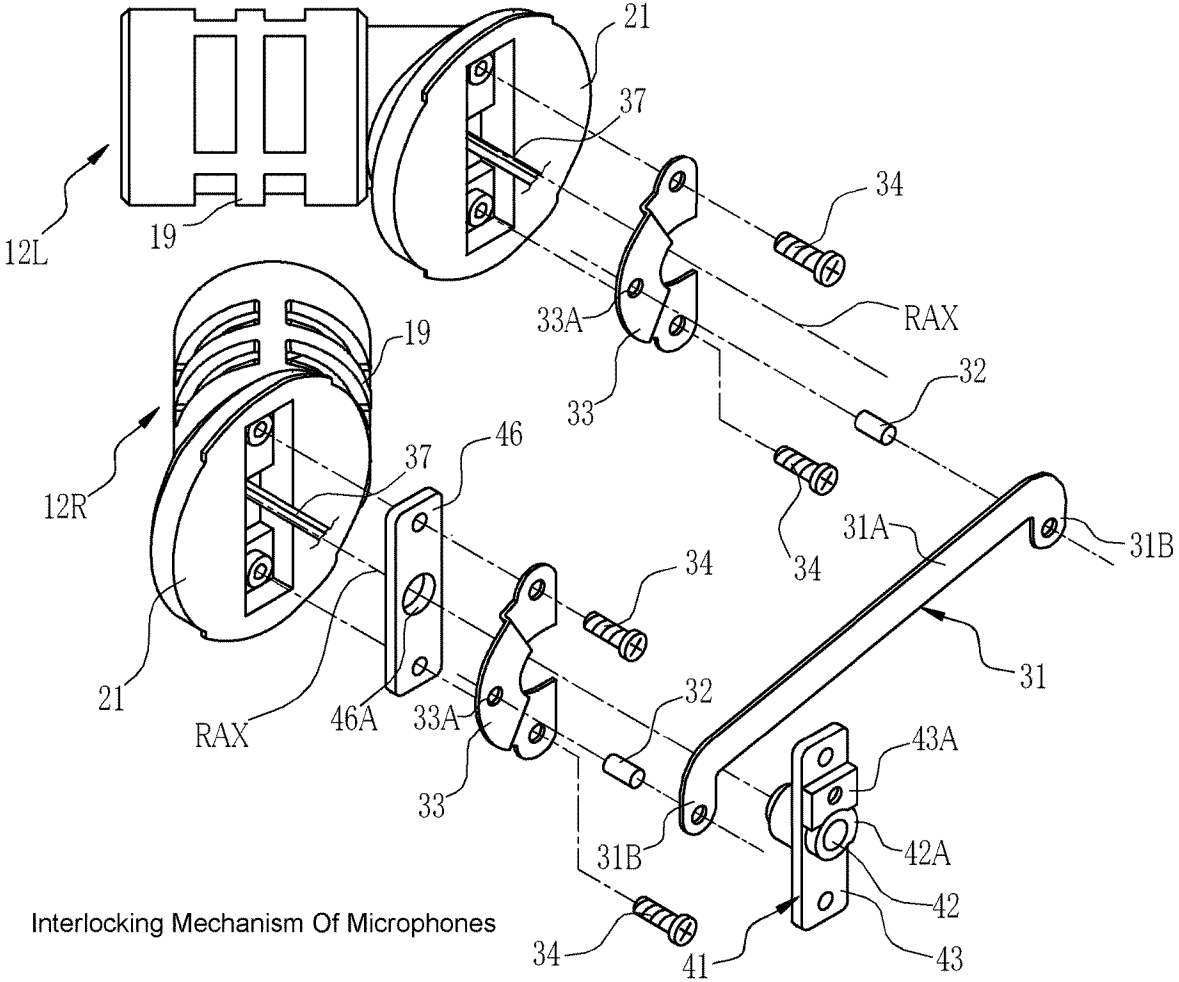
FIG. 10 is a diagram illustrating an interlocking mechanism of the pair of microphones.

As shown in FIGS. 9 and 10, the voice recorder 10 is provided with an interlocking mechanism which turns one holder 21 in cooperation with the other holder 21 while one of the microphones 12R and 12L is being turned. The interlocking mechanism transmits a turning force from one holder 21 to the other holder 21, for turning the other holder 21. The interlocking mechanism in this embodiment is constituted of a joint member 31.

The joint member 31 has an arm 31A and joints 31B which are at opposite ends of the arm 31A and are connected to the holders 21, respectively. Each joint 31B is fixed to each holder 21 by a joint-pin 32. As shown in FIG. 10, on the back of each holder 21, a clamping plate 33 to fix the joint member 31 is provided and attached to each holder 21 with screws 34. The clamping plates 33 have fitting holes 33A which pivotally hold the joint-pins 32, respectively. Each joint 31B is attached to each holder 21 through the joint-pin 32. Each joint 31B is held rotatable relative to the holder 21 about the axis of the joint-pin 32.

Figure 11:
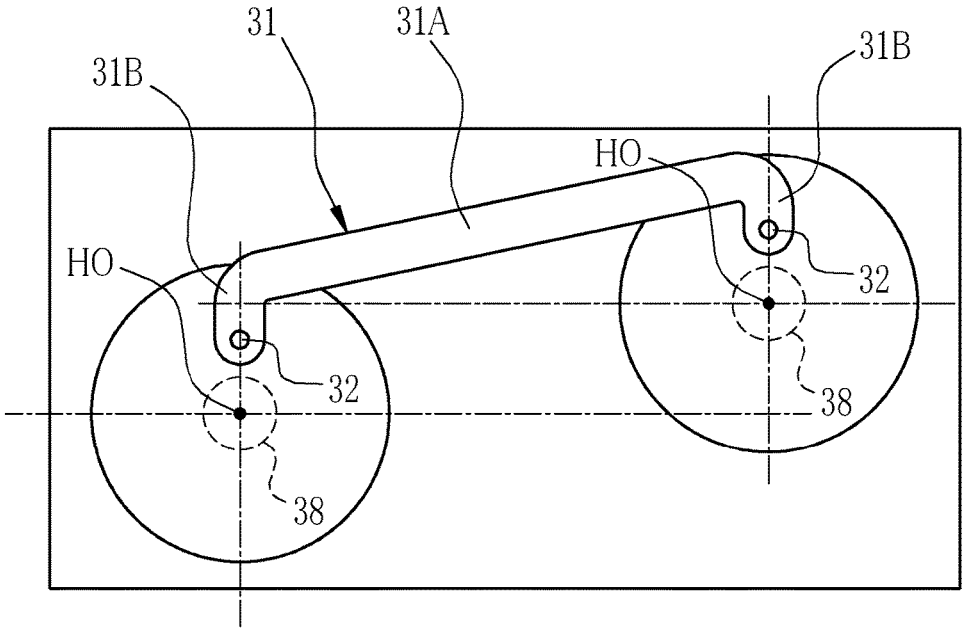
FIG. 11 is a diagram illustrating the shape of a joint member and the mounting position thereof.
Figure 11:
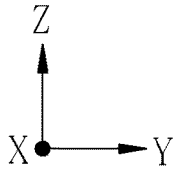

As shown in FIG. 11, each joint 31B is connected at a position that is in offset from the rotation center HO (the rotation axis RAX) of each holder 21. When one holder 21 turns, the action of the joint member 31 connected under such a positional relationship transmits the turning force of the holder 21 to the other holder 21 as the turning force.

In each holder 21, a wire-drawing aperture 38 to draw out the wires 37 from each case 19 is formed at a position that includes the rotation center HO. The wire 37 is a signal line which sends electrical signals responsive to the vibration of the diaphragm 18 to the body section 11. While the holders 21 are turning, the wires are hard to be twisted if the wire-drawing apertures 38 are formed at the respective rotation centers HO of the holders 21, as compared with a case where the wire-drawing apertures 38 being formed away from the rotation center HO.

Also, in this embodiment, the following configuration is devised so that the wires 37 and the joint member 31 will not intersect while the holders 21 are turning. Specifically, each joint 31B of the joint member 31 is bent into an L shape and in the same direction with respect to the longitudinal direction of the arm 31A. The joint member 31 of such a shape is attached to the holders 21 in a mounting position as shown in FIG. 11. In the mounting position, the both ends of the arm 31A are located on the opposite side to the rotation centers HO across the joint-pins 32, respectively, in the condition where the joint-pin 32, which serves as a pivot axle of each joint 31B, and the rotation center HO of each holder 21 are aligned in the height-direction (Z-direction).

Applying the devised geometric configuration of the joints 31B to the joint member 31 and setting the joint member 31 in the mounting position to the holders 21, as shown in FIG. 11, will prevent the arm 31A of the joint member 31 from intersecting the wires drawn from the wire-drawing apertures 38, within a range in which the holders 21 turn by 180 degrees between the inward position and the outward position.

Also, the joint member 31 is mounted so that the interlocked holders 21 can turn in the same direction. That is, in FIG. 11, one holder 21 turns clockwise as the other holder 21 turns clockwise.

Also, in FIG. 10, a torque hinge 41, which gives the turning force to the holders 21, is equipped in one of the right and left microphones 12R and 12L (the microphone 12R on the right side in this embodiment)

The torque hinge 41 in this embodiment is provided to stabilize each microphone 12R, 12L in either of the inward and outward positions. When the holder 21 starts to turn from either of the inward and the outward positions to the other position, the torque hinge 41 gives the turning force to each holder 21 in a predetermined manner. Specifically, the torque hinge 41 gives the holders 21 the turning force in a direction urging the holders 21 to return to the initial position before the turning until the holders 21 arrive at a predetermined rotational position. Whereas, the torque hinge 41 gives the turning force in a direction urging the folder 21 to move to the other position after the holders 21 arrived at the predetermined rotational position. This action of the torque hinge 41 contributes to stabilizing the microphones 12R and 12L either in the inward position or in the outward position.

The torque hinge 41 is provided with a pivot member 42 and a fixed portion 43 which is fixed to holder 21. The fixed portion 43 in this embodiment has a reed shape. The pivot member 42 is of a circular shape in section, and is provided with a convex contact portion 42A sticking out from the periphery of the pivot member 42 in the Y-direction which is perpendicular to the rotation axis RAX. The torque hinge 41 is attached to the holder 21 in a position where the rotation center of the pivot member 42 and the rotation center HO of the holder 21 are aligned. The pivot member 42 is rotatable relative to the fixed portion 43.

A turn-regulating portion 43A, with which the contact portion 42A is brought into contact, is provided on the fixed portion 43. One side of the contact portion 42A is brought into contact with the turn-regulating component 43A in the inward position, whereas the other side of the contact portion 42A is brought into contact with the turn-regulating portion 43A in the outward position where the holder 21 turns 180 degrees from the inward position. This way, the turn-range of the holder 21 between the inward position and the outward position is restricted within 180 degrees.

The holder 21 has an attaching member 46, and the torque hinge 41 is incorporated in the holder 21 by fitting the pivot member 42 to the aperture 46A of the attaching member 46. The clamping plate 33 is arranged between the attaching member 46 and the torque hinge 41. The torque hinge 41 is attached to the clamping plate 33 with a gap between the clamping plate 33 and the fixed portion 43, allowing entrance of the joint member 31 into the gap.

The operation of the configuration as set forth above will be described with reference to FIGS. 12A to 12E and FIGS. 13A to 13E. FIGS. 12A to 12E and FIGS. 13A to 13E are state transition diagrams that explain how the microphones 12R and 12L are changed from the inward position to the outward position while the holders 21 are being turned. FIGS. 12A to 12E show the views seen from the front side 11C of the body section 11 in the front position where the top surface 11A is on the upper side. FIGS. 13A to 13E show the views seen from the back of the front side 11C of the body section 11 in the front position, corresponding to FIGS. 12A to 12E, respectively.

Figure 12A:
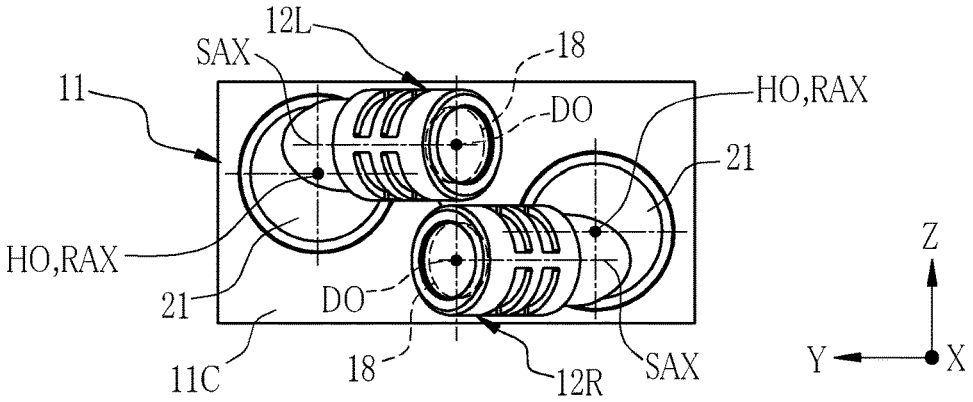
FIG. 12A is a state diagram of the pair of microphones in the inward position.
Figure 12B:
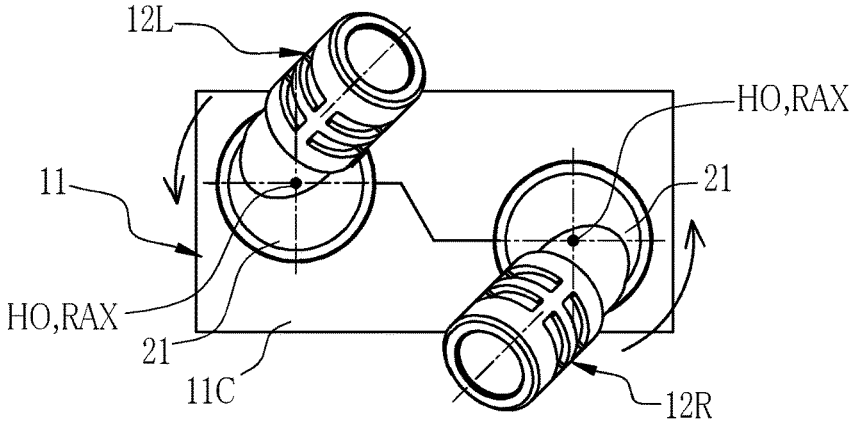
FIG. 12B is a state diagram of the pair of microphones turned 45 degrees from the inward position.
Figure 12C:
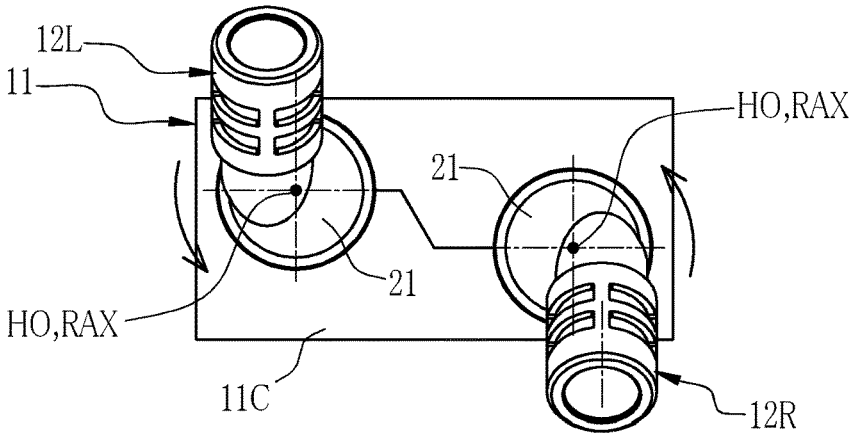
FIG. 12C is a state diagram of the pair of microphones turned 90 degrees from the inward position.
Figure 12D:
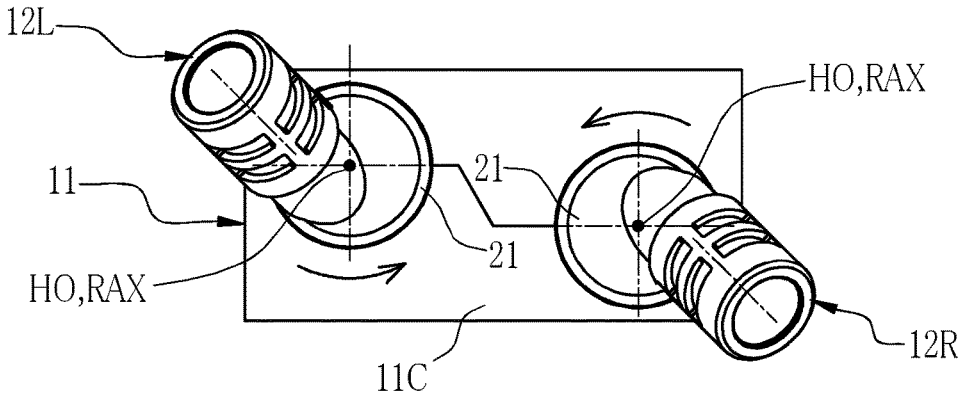
FIG. 12D is a state diagram of the pair of microphones turned 135 degrees from the inward position.

As shown in FIGS. 12A and 12B, when each microphone 12R, 12L of the voice recorder 10 is positioned in the inward position, the sound-collecting axis SAX of each microphone 12R, 12L is parallel to the X-Y plane. In addition, the sound-collecting axes of the microphones 12R and 12L intersect each other, and in the present embodiment, at a point at which the centers DO of the respective diaphragms 18 overlap as viewed from the Z-direction. Thereby, the phase difference between the right and left microphones 12R and 12L becomes zero.

Figure 12E:
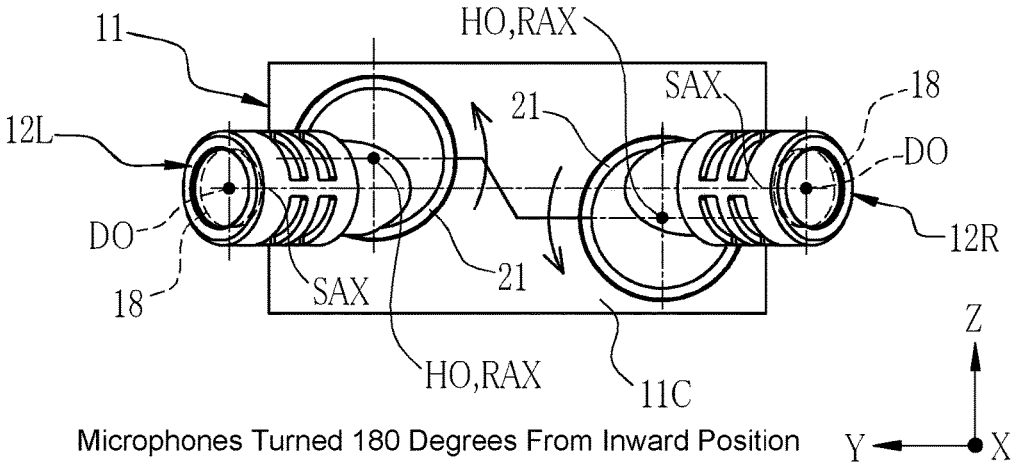
FIG. 12E is a state diagram of the pair of microphones turned 180 degrees from the inward position.

In the case of changing the microphones 12R and 12L from the inward position shown in FIG. 12A to the outward position shown in FIG. 12E, the microphones 12R and 12L are turned away from each other, as shown in FIG. 12B. In this embodiment, each microphone 12R, 12L is turned counterclockwise, seen from the front, as shown in FIG. 12B. Turning each microphone 12R, 12L from the inward position shown in FIG. 12A by 90 degrees brings the microphones to the position shown in FIG. 12C, and turning by 135 degrees brings the microphones to the position shown in FIG. 12D. Turning by 45 degrees further from the position of FIG. 12D brings the microphones to the outward position where the microphones are turned from the inward position by 180 degrees.

Since the outward position is the position turned by 180 degrees from the inward position, the sound-collecting axis SAX of each microphone 12R, 12L in the outward position is parallel to the X-Y plane, as in the inward position. In the outward position, the sound-collecting axes SAX of the microphones 12R and 12L do not intersect each other but are oriented outward from each other. In addition, in this embodiment, the microphones 12R and 12L are in the same height in the outward position.

As described above, each sound-collecting axis SAX of each microphone 12R, 12L is arranged offset from the individual rotation axis RAX of each holder 21 in the direction that the sound-collecting axes SAX are spaced apart from each other in the inward position. This allows the cases 19 of the microphones 12R and 12L to intersect each other in the inward position to reduce the right-and-left phase difference.

Also, because each holder 21 can turn between the inward position and the outward position turned by 180 degrees from the inward position, it is possible to select the inward position or the outward position merely by the turning operation. Thus, the voice recorder 10 in this embodiment facilitates the operation and simplifies the structure to change the position of each microphone 12R, 12L, as compared to the prior art that requires sliding one microphone to enable intersecting with the other.

In this embodiment, in addition, the diaphragms 18 of the microphones 12R and 12L intersect at the centers thereof in the inward position. This provides a zero right-and-left phase difference.

Furthermore, in this embodiment, the offset distance OFS, which is the distance from the rotation axis RAX of each holder 21 to the sound-collecting axis SAX, is equal between the right and left microphones 12R and 12L, though the offset direction is by 180 degrees but the same distance, in the right-and-left microphone 12R, 12L. In the outward position turned by 180 degrees from the inward position, accordingly, this can make the same height of each microphone 12R, 12L in the Z-direction.

Figure 13A:
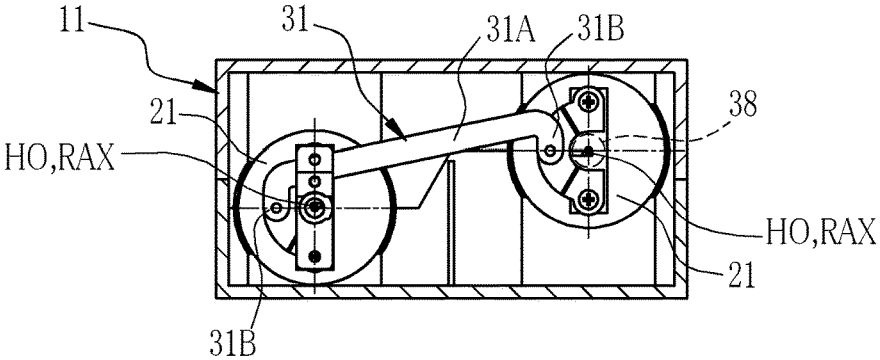
FIG. 13A is a state diagram corresponding to FIG. 12A, viewed from a back side at which the joint member is disposed.
Figure 13B:
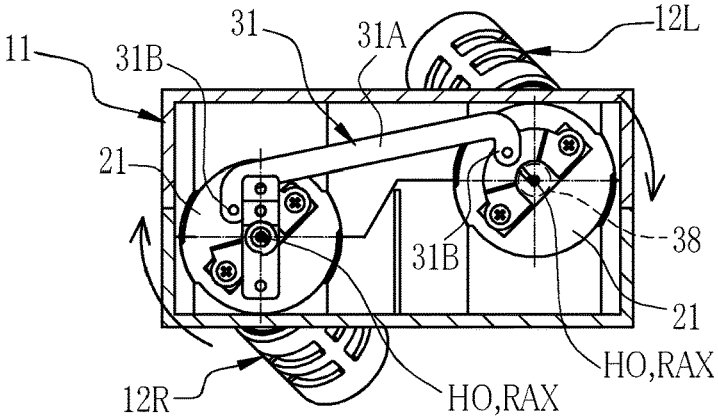
FIG. 13B is a state diagram corresponding to FIG. 12B, viewed from the back side at which the joint member is disposed.

As shown in FIG. 13A, showing the state transition of each microphone 12R, 12L from the back, the holders 21 holding the microphones 12R and 12L rotatable are interconnected with the joint member 31. Accordingly, as shown in FIG. 13B, turning one of the microphones 12L and 12R makes the other microphone turn along with the one microphone through the action of the interlocking mechanism.

Figure 13C:
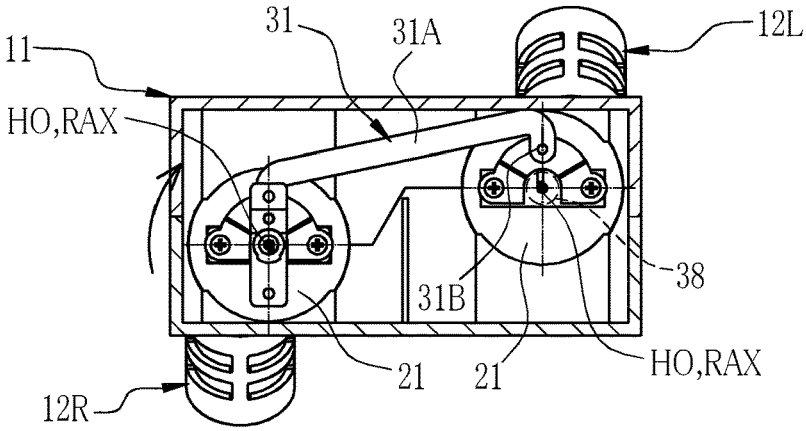
FIG. 13C is a state diagram corresponding to FIG. 12C, viewed from the back side at which the joint member is disposed.
Figure 13D:
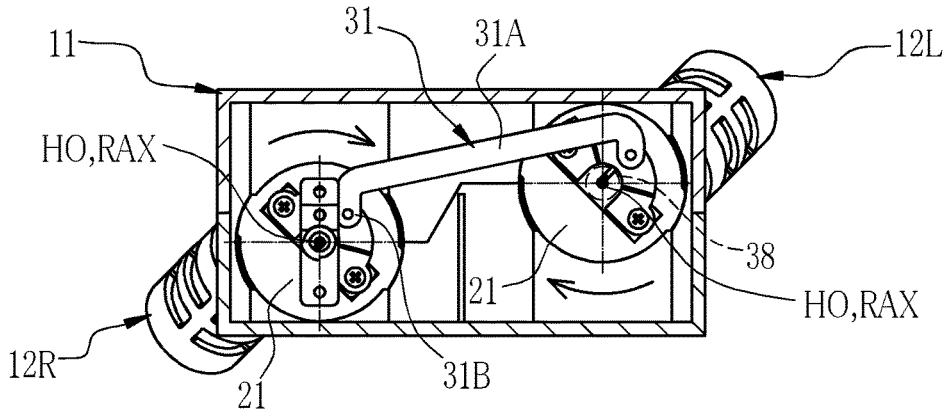
FIG. 13D is a state diagram corresponding to FIG. 12D, viewed from the back side at which the joint member is disposed.

Turning each microphone 12R, 12L by 90 degrees from the inward position shown in FIG. 13A provides the position shown in FIG. 13C, and turning by 135 degrees provides the position shown in FIG. 13D. Turning further 45 degrees provides the outward position turned 180 degrees from the inward position, as shown FIG. 13E.

Thus, the holders 21 are interlocked through the interlocking mechanism, so that there is no need for turning each holder 21 individually. The change between the inward position and the outward position can be performed with a single action.

Furthermore, in each holder 21, the wires 37 are drawn from the wire-drawing aperture 38 formed at the position including the rotation center HO. As a result, since the wires 37 are located near to the rotation center HO, the wires 37 are hard to be twisted when each holder 21 and each microphone 12R, 12L are turned. This can suppress breaking the wires 37.

In addition, as described above, at the opposite ends of the arm 31A, the joint member 31 has the joints 31B bent into an L shape and in the same direction with respect to the longitudinal direction of the arm 31A. And, as shown in FIG. 13C, the joint member 31 is mounted in such a position that the opposite ends of the arm 31A are positioned on the opposite side to each rotation center HO across each joint pin 32 in the position where the joint pin 32 which serves as the pivot axle of each joint 31B and the rotation center HO are aligned in the height direction (Z-direction).

Figure 13E:
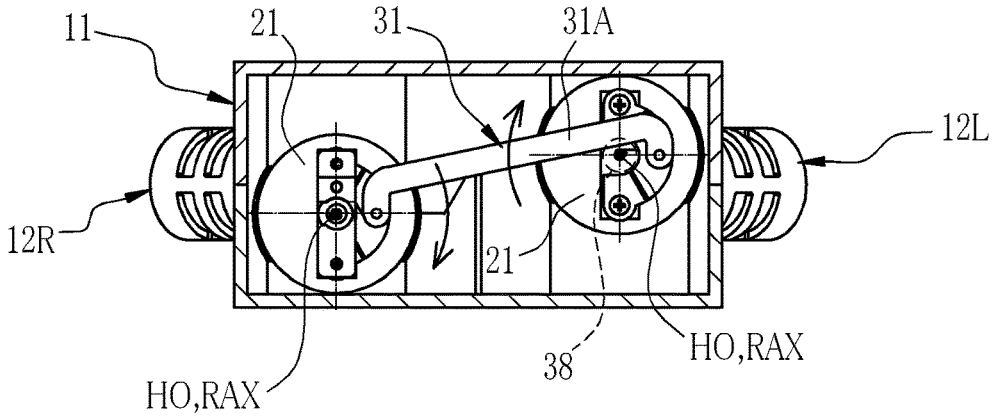
FIG. 13E is a state diagram corresponding to FIG. 12E, viewed from the back side at which the joint member is disposed.

Subsequently, within the 180-degree turning range from the inward position shown in FIG. 13A to the outward position shown in FIG. 13E, the arm 31A does not move in either area of the wire-drawing aperture 38 while the holders 21 are being turned. Thereby, the joint member 31 is prevented from interfering with the wires 37 drawn out from the wire-drawing apertures 38, which prevents breakage of the wires 37 due to the interference.

[Variation Devising a Method for Fixing the Wires]

Figure 14:
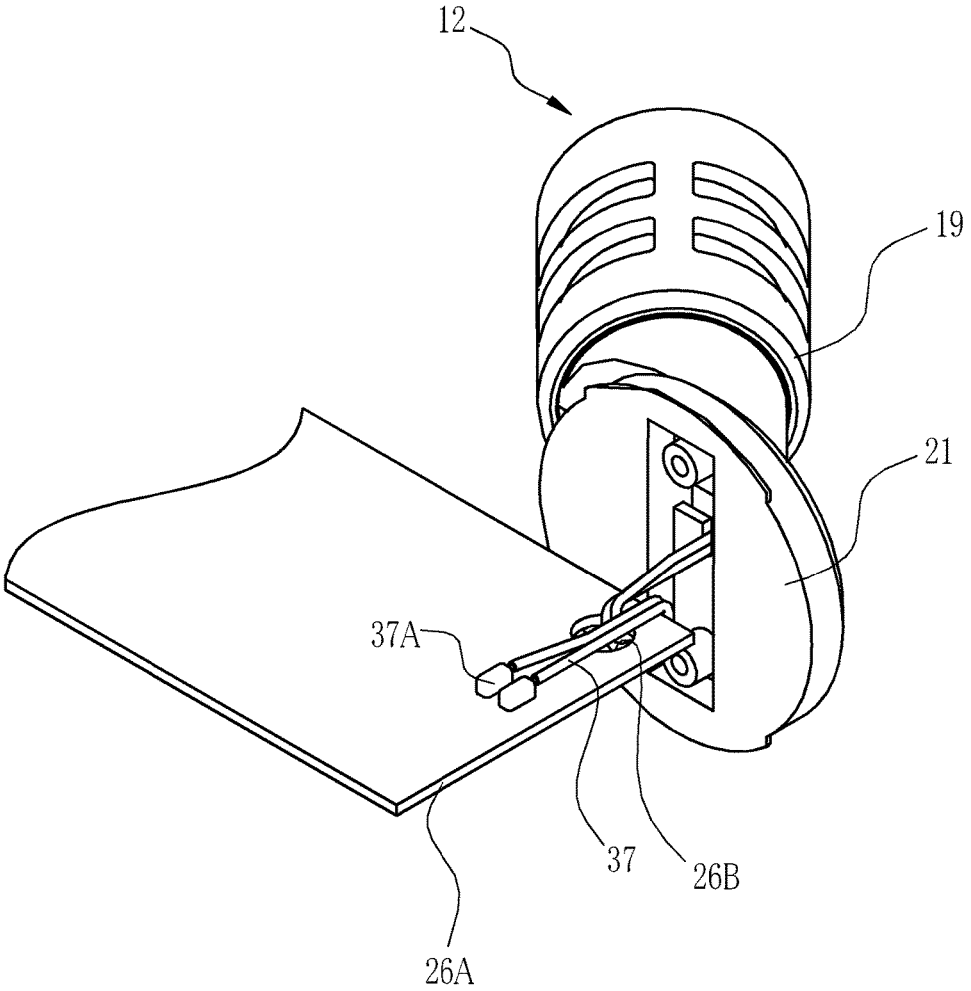
FIG. 14 is a perspective view illustrating a method to fix wires to a circuit board.
Figure 14:
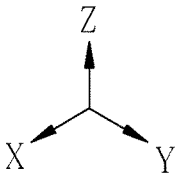
Figure 15:
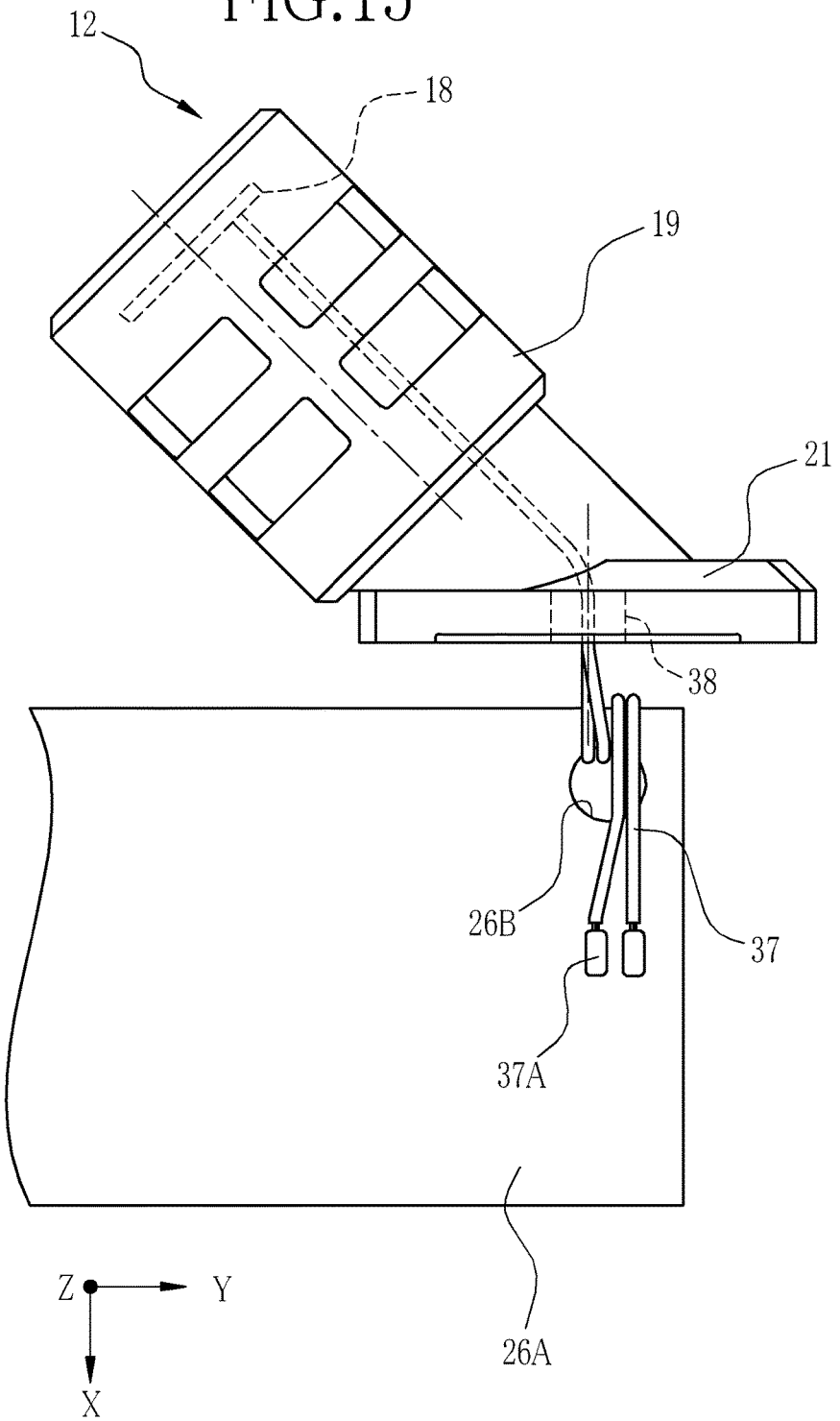
FIG. 15 is a plan view illustrating a method to fix the wires to the circuit board.

As shown in FIGS. 14 and 15, it is preferable to wind and fix the wires 37 to a circuit board 26A of the circuit unit 26 when connecting the wires 37 drawn out from each microphone 12R, 12L to the circuit board 26A.

One end 37A of each wire 37 is fixed to the circuit board 26A by soldering. As mentioned above, turning the holder 21 results some twist of the wires 37 even where the wires 37 are drawn out from the wire-drawing aperture 38 formed in the position including the rotation center HO of the holder 21. When the wire 37 is twisted, a force such as tension exerts on the wire 37, and the force will concentrate on one end 37A as a relatively weak portion of the wire 37. This can cause breakage of the wire 37.

Addressing this problem, a wire-winding aperture 26B to wind the wires 37 on the circuit board 26A is formed in the circuit board 26A. The wire rod 37, passing through the wire-winding aperture 26B, is wound on the circuit board 26A. In this state, one end 37A is fixed to the circuit board 26A by soldering. Even if the tension exerts on the wire 37 with the holder 21 being turned, this devise makes the tension dispersed over a wound portion of the wire 37 on the circuit board 26A, which suppresses the tension from gathering on one end 37A. This prevents breaking the wires 37.

As shown in FIGS. 14 and 15, the wire-winding aperture 26B is located near the wire-drawing aperture 38 through which the wires 37 are drawn out from the holder 21. Specifically, the wire-winding aperture 26B is located to face the wire-drawing aperture 38 in the width-direction (Y-direction) and the height-direction (Z-direction) of the body section 11. This arrangement makes it possible to smoothly draw the wires 37 from the wire-drawing aperture 38 to the location of the wire-winding aperture 26B, without causing unnecessary twists and curves in the wires 37.

[Variation in the State of Intersection of the Microphones]

Figure 16:
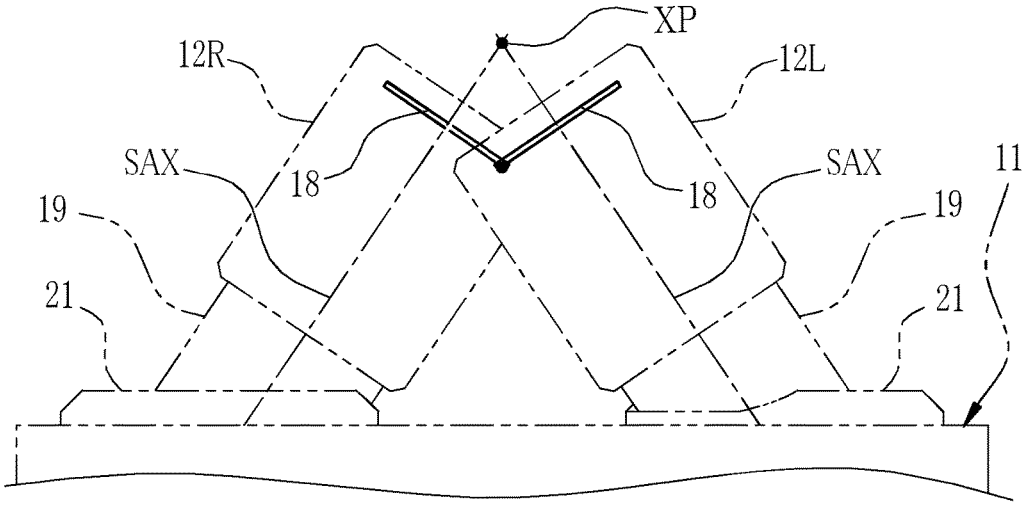
FIG. 16 is a diagram illustrating an example in which the diaphragms overlap each other at edge portions thereof.
Figure 17:
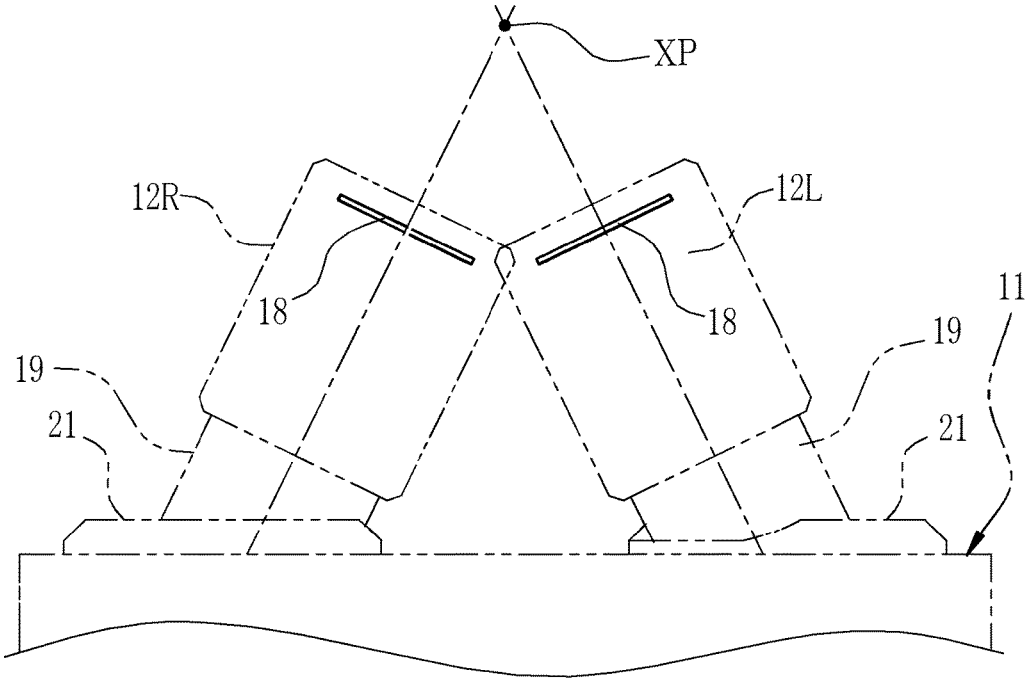
FIG. 17 is a diagram illustrating an example in which cases overlap each other at edge portions thereof.

In the above embodiment, the microphones 12R and 12L do not necessarily intersect at the centers DO of the diaphragms 18 but may intersect at an edge of each diaphragm 18, as shown in FIG. 16. Another configuration is also possible, as shown in the FIG. 17, wherein the cases 19 of the microphones 12R and 12L may merely partly intersect. This is because the effect of reducing the right-and-left phase difference can be obtained even in the state shown in FIG. 16 and the state shown in FIG. 17 as well, in comparison with the state in which the microphones 12R and 12L do not intersect. Not to mention, it is the most preferable intersecting at the centers DO of the diaphragms 18, as shown in FIG. 4. As mentioned above, zero right-and-left phase difference is achieved by this arrangement.

[Aspects of the Interlocking Mechanism]

With regard to the aspects of the interlocking mechanism for the holders 21, the system illustrated in the above embodiment is constituted of the joint member 31 having a stick-like shape. The shape of joint member 31, however, may also be another shape, not limited to the above example. The interlocking mechanism may also be constructed using gears or the like in place of the joint member 31. In addition, the holders 21 and the interlocking mechanism may be driven by a motor.

Also, the interlocking mechanism may not be necessary. Without the interlocking mechanism, it is necessary to turn each holder 21 individually. Also in this case, however, the position of each microphone can be changed merely by the tuning operation. In comparison with the prior art which needs the sliding operation in addition to the turning operation, the effects of simplifying the operation and the construction can be obtained in this case.

The present invention is not limited to the above embodiment, but appropriate changes are possible without departing from the purpose of the present invention, including a combination of the above embodiment and variations, for example.

What is claimed is:

1. A voice recorder comprising:

a body section;

a pair of microphones, including a right microphone and a left microphone, each having a diaphragm to collect voices, wherein a sound-collecting axis perpendicular to the diaphragm extends in an axial direction of each of the microphones; and two holders placed side by side on the body section, the holders being capable of turning on respective rotation axes which are parallel to each other in a direction perpendicular to a front surface of the body section, the holders holding the microphones respectively with each sound-collecting axis tilted from the rotation axis, to change the microphones between an inward position in which the sound-collecting axes intersect each other and an outward position in which the sound-collecting axes do not intersect, by turning the microphones 180 degrees from the inward position to the outward position, wherein the microphones are placed offset from the respective rotation axes on the holders such that, in the inward position, the sound-collecting axes are spaced apart from each other in a vertical direction parallel to a vertical plane which is perpendicular to both of the parallel rotation axes.

2. The voice recorder cited in claim 1, wherein each sound-collecting axis is parallel to a horizontal plane perpendicular to the vertical plane in the inward position and in the outward position.

3. The voice recorder cited in claim 2, wherein the holders are staggered such that the rotation axes are spaced apart from each other in the vertical direction.

4. The voice recorder cited in claim 3, wherein, in the vertical plane, each microphone has the same offset distance which is a distance from the rotation axis of one holder to the sound-collecting axis of one microphone held on the one holder.

5. The voice recorder described cited in claim 1, wherein the diaphragms of the microphones intersect each other in the inward position.

6. The voice recorder cited in claim 5, wherein the diaphragms of the microphones intersect at the center of each diaphragm in the inward position.

7. The voice recorder cited in claim 1, wherein a wire for sending electrical signals responsive to vibration of the diaphragm to the body section is drawn from an aperture formed in each holder at a position including the rotation center of the holder.

8. The voice recorder cited in claim 7, comprising a circuit board to which one end of each of the wires from the diaphragms is connected, and apertures provided in the circuit board, for putting the wires therethrough and winding the wires on the circuit board.

9. A voice recorder comprising:

a body section;

a pair of microphones, including a right microphone and a left microphone, each having a diaphragm to collect voices, wherein a sound-collecting axis perpendicular to the diaphragm extends in an axial direction of each of the microphones; and two holders placed side by side on the body section, the holders being capable of turning on respective rotation axes which are parallel to each other, the holders holding the microphones respectively with each sound-collecting axis tilted from the rotation axis, to change the microphones between an inward position in which the sound-collecting axes intersect each other and an outward position in which the sound-collecting axes do not intersect, by turning the microphones 180 degrees from the inward position to the outward position, wherein the microphones are placed offset from the respective rotation axes on the holders such that, in the inward position, the sound-collecting axes are spaced apart from each other in a vertical direction parallel to a vertical plane which is perpendicular to both of the parallel rotation axes, wherein each sound-collecting axis is parallel to a horizontal plane perpendicular to the vertical plane in the inward position and in the outward position, wherein the holders are staggered such that the rotation axes are spaced apart from each other in the vertical direction, wherein, in the vertical plane, each microphone has the same offset distance which is a distance from the rotation axis of one holder to the sound-collecting axis of one microphone held on the one holder, wherein the offset distance OFS is a half of a distance PV that is determined by formula (1) below, assuming that PV represents the distance between the rotation axes of the holders in the vertical direction:

$$PV=(D/2+D/2+C)/2 \qquad \text{formula(1)}$$

wherein, D represents a diameter of each microphone and C represents a clearance between the microphones.

10. The voice recorder cited in claim 9, wherein, assuming that PH represents a distance between the rotation axes of the holders in the horizontal plane, the distance PH is determined by formula (2) below, on the basis an intersection point at which the two sound-collecting axes intersect:

$$PH=2L\cdot\cos(90°-\theta/2) \qquad \text{formula (2)}$$

wherein, L represents a length of each sound-collecting axis from the intersection point to the rotation axis of each holder, and θ represents an angle of two intersecting sound-collecting axes.

11. A voice recorder comprising:

a body section;

a pair of microphones, including a right microphone and a left microphone, each having a diaphragm to collect voices, wherein a sound-collecting axis perpendicular to the diaphragm extends in an axial direction of each of the microphones; and two holders placed side by side on the body section, the holders being capable of turning on respective rotation axes which are parallel to each other, the holders holding the microphones respectively with each sound-collecting axis tilted from the rotation axis, to change the microphones between an inward position in which the sound-collecting axes intersect each other and an outward position in which the sound-collecting axes do not intersect, by turning the microphones 180 degrees from the inward position to the outward position, wherein the microphones are placed offset from the respective rotation axes on the holders such that, in the inward position, the sound-collecting axes are spaced apart from each other in a vertical direction parallel to a vertical plane which is perpendicular to both of the parallel rotation axes, and an interlocking mechanism which interlocks the holders to cause one holder to turn as the other holder is turned.

12. The voice recorder cited in claim 11, wherein the interlocking mechanism includes a joint member which is connected on opposite ends thereof to the holders at positions which are in offset from rotation centers of the holders, respectively, to transmit a turning force of one holder to the other holder as a turning force therefor, the joint member having an arm portion and joint portions provided to be respectively connected to the holders on opposite ends of the arm portion, each joint portion being bent into an L shape in the same direction with respect to a longitudinal direction of the arm portion.

* * * * *